US007810655B2

(12) United States Patent
Wang

(10) Patent No.: US 7,810,655 B2
(45) Date of Patent: Oct. 12, 2010

(54) HANGING ORGANIZER

(76) Inventor: Wen-Tsan Wang, 6F., No. 300, Jui Kuang Road, Taipei city (TW)

( * ) Notice: Subject to any disclaimer, the term of this patent is extended or adjusted under 35 U.S.C. 154(b) by 93 days.

(21) Appl. No.: 12/391,270

(22) Filed: Feb. 24, 2009

(65) Prior Publication Data

US 2010/0213150 A1 Aug. 26, 2010

(51) Int. Cl.
*A47F 5/08* (2006.01)

(52) U.S. Cl. ..... 211/118; 211/119.004; 108/149; 248/327

(58) Field of Classification Search ..... 211/118, 211/119.004; 108/149; 312/6, 351; 248/339, 248/340, 323, 327
See application file for complete search history.

(56) References Cited

U.S. PATENT DOCUMENTS 1,331,621 A * 2/1920 Carlin ..... 108/182
3,799,072 A * 3/1974 Slaboden ..... 108/107
4,311,243 A * 1/1982 Hui-Lai ..... 211/113
4,358,232 A * 11/1982 Griffith ..... 410/100
5,542,530 A * 8/1996 Freelander ..... 206/292
6,116,164 A * 9/2000 Justen, Jr. ..... 108/42
6,354,232 B1 * 3/2002 Hulke ..... 108/149
6,595,145 B1 * 7/2003 Lietz ..... 108/149
6,637,609 B2 * 10/2003 Stevens ..... 211/118

* cited by examiner

*Primary Examiner*—Korie Chan
(74) *Attorney, Agent, or Firm*—Leong C. Lei

(57) ABSTRACT

A hanging organizer includes a top panel having vertical slots, storage boxes arranged at different elevations below the top panel, hanging straps for hanging the top panel on a hanging rod directly or on a door panel by means of hanging hooks, each hanging strap having one end affixed to one front vertical slot of the top panel and an opposite end inserted through one rear vertical slot of the top panel and folded portions respectively inserted through respective horizontal slots on the storage boxes, first pins inserted through respective transverse through holes on the hanging strap and stopped at the bottom side of the top panel, suspension straps inserted through respective vertical slots of the top panel, and second pins respectively inserted through a through hole at the top end of each suspension strap to secure each suspension strap to the top panel and set in folded portions of the suspension straps and stopped at the inside of the storage boxes to secure the storage boxes to the suspension straps.

5 Claims, 8 Drawing Sheets

HANGING ORGANIZER

BACKGROUND OF THE INVENTION (a) Technical Field of the Invention

The present invention relates to organizers and more particularly, to a hanging organizer that can be detachably adjustably set up by a user to fit different requirements for keeping different storage items.

(b) Description of the Prior Art

Due to limited indoor space, the number and dimension of wardrobes are limited. Therefore, hanging organizers are widely invited by people living in a small house space for holding clothes and other small items. Regular commercial hanging organizers are commonly made of flexible and strong canvass, having multiple compartments of different shapes and sizes located on the front side for keeping different storage items. These hanging organizers commonly have a hanging hole or hanging hook at the top side for hanging on a hanging rod or door panel. Hook and loop materials may be used for securing a hanging organizer to support means.

Further, regular wardrobes or cabinets are of fixed type. They cannot be detached and reorganized to change the combination. There are simple types of plastic wardrobes and cabinets that are detachable and can be built up by a user. However, these simple types of plastic wardrobes and cabinets are not durable. They commonly have an image of a low quality level. Further, these simple types of plastic wardrobes and cabinets do not have a nice looking.

There are commercial hanging organizers made of canvass. These hanging organizers have multiple compartments for keeping different storage items in good order. However, these hanging organizers are made in a fixed shape by means of stitching. They cannot be adjusted or attached with extra storage compartments to fit different requirements.

SUMMARY OF THE INVENTION

The primary purpose of the present invention is to provide a hanging organizer, which is detachable and can be conveniently built up by a user. It is another object of the present invention to provide a hanging organizer, which can be freely arranged in different forms to fit different requirements.

To achieve these and other objects of the present invention, a hanging organizer comprises a top panel, storage boxes, hanging straps, suspension straps, and first and second pins. The top panel has a plurality of vertical slots cut through top and bottom walls thereof and respectively disposed near front and rear sides thereof. Each storage box has a plurality of horizontal slots cut through peripheral walls thereof. Each hanging strap has a first end affixed to one vertical slot near the front side of the top panel, a second end inserted through one vertical slot near the rear side of the top panel, and a transverse through hole. Each hanging strap has multiple portions thereof folded up and inserted through one horizontal slot of each of the storage boxes. The suspension straps are respectively inserted through one respective vertical slot near the front side of the top panel, each having a transverse through hole located on one end thereof. Further, each suspension strap has multiple portions thereof folded up and inserted through one horizontal slot of each of the storage boxes. The first pins are respectively inserted into the transverse through holes of the hanging straps and stopped at the bottom side of the bottom wall of the top panel. The second pins are respectively inserted into the transverse through hole of the suspension straps and the folded portions of the hanging straps and the suspension straps and respectively stopped at the top side of the top wall of the top panel and an inner side of each of the storage boxes to secure the storage boxes to the hanging straps and the suspension straps at different elevations.

Further, hanging hooks are fastened to the hanging straps for hooking on the topmost edge of a door panel to hang the hanging straps on the door panel. Each hanging hook has a transverse slot. Each hanging strap has a portion folded up and inserted through the transverse slot one hanging hook and mounted with a pin in the folded portion to have the folded portion be secured to the hanging hook.

Further the first and second ends of the hanging straps can be respectively inserted through the vertical slots of the top panel and affixed thereto with stitches. Further, the suspension straps are respectively fastened to the top panel and the storage boxes at two opposite lateral sides.

Further, the storage boxes can be fastened to the suspension straps by means of forming hook holes on each storage box and providing the suspension straps with hooks for hooking in the hook holes of said storage boxes.

Further, the storage boxes can be fastened to the suspension straps by means of providing the storage boxes with first fastening members located and the suspension straps with second fastening members that are detachably connectable to the first fastening members.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
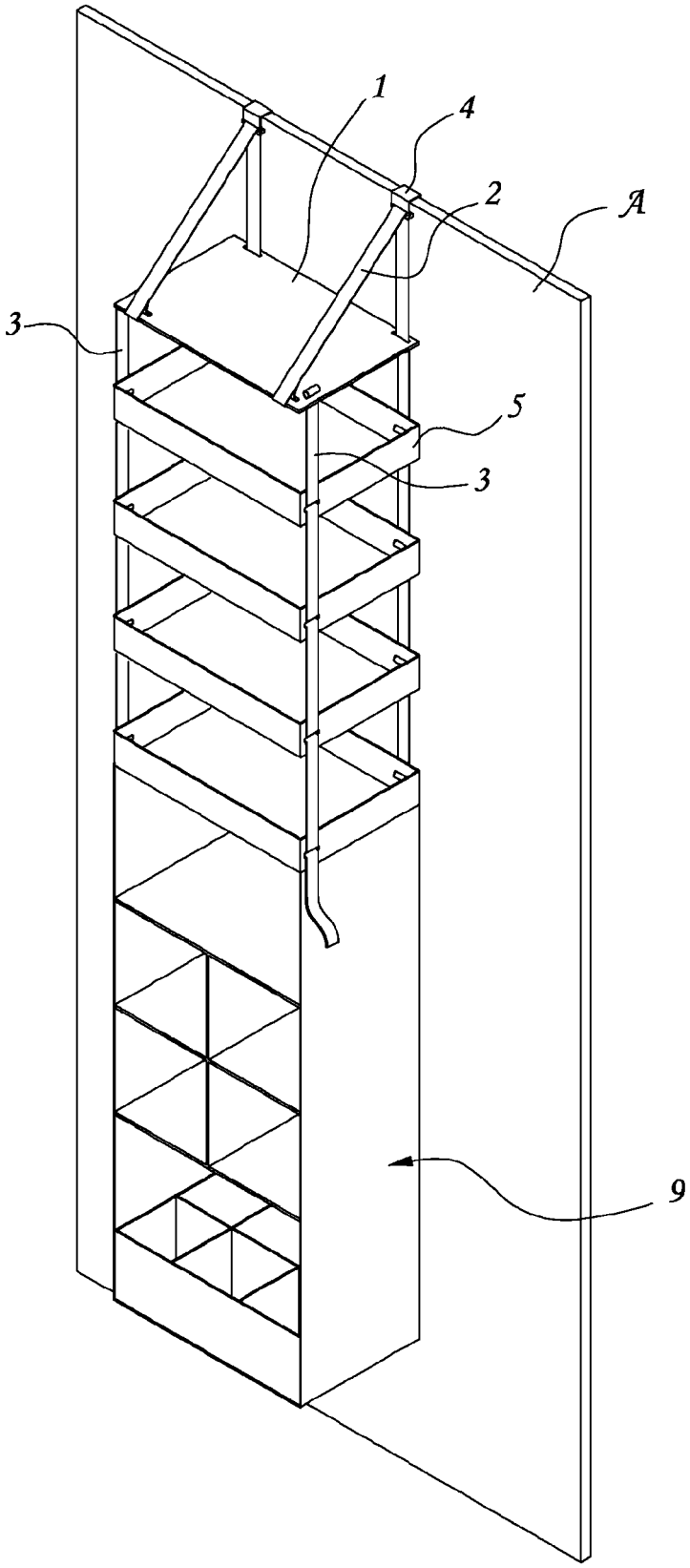
FIG. 1 is an elevational view of a hanging organizer in accordance with the present invention.

Referring to FIG. 1, a hanging organizer in accordance with the present invention is shown hung on the top edge of the door panel A of a door inside a house for keeping things in good order. The hanging organizer comprises a top panel 1, a plurality of hanging straps 2, a plurality of suspension straps 3, a plurality of hanging hooks 4, a plurality of storage boxes 5, and a cabinet 9. Each hanging strap 2 has its one end fastened to the front side of the top panel 1, and its other end extended to the rear side of the top panel 1 to connect the storage boxes 5 in series. The handing hooks 4 are respectively fastened to the middle part of each of the hanging straps 2 and hung on the top edge of the door panel A. The suspension straps 3 are fastened to the top panel 1 to connect the storage boxes 5 and cabinet 9 in series below the top panel 1.

Figure 2:
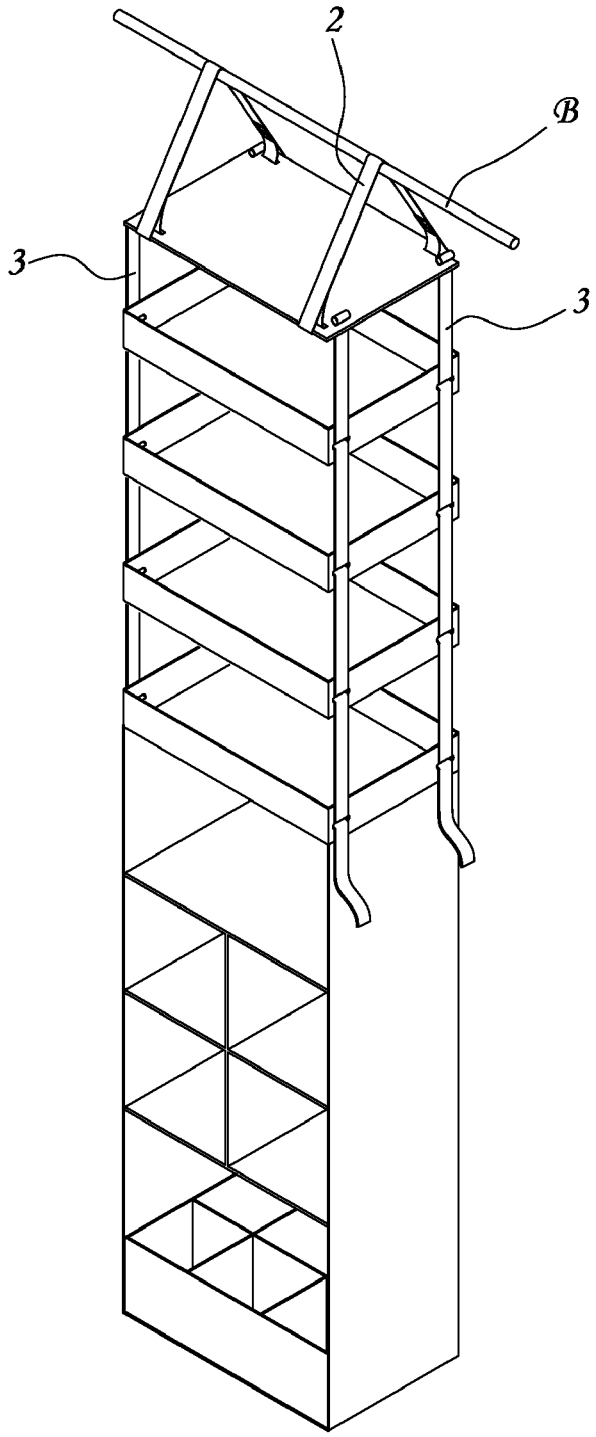
FIG. 2 is an elevational view of an alternate form of the hanging organizer in accordance with the present invention.

FIG. 2 shows an alternate form of the present invention. According to this embodiment, each hanging strap 2 has its two distal ends respectively fastened to the front and rear sides of the top panel 1; the suspension straps 3 are respectively fastened with their one ends to the four corners of the top panel to connect the storage boxes 5 and the cabinet 9 in series below the top panel 1; a hanging rod B is used to hang the hanging organizer in a wardrobe (not shown).

Figure 3:
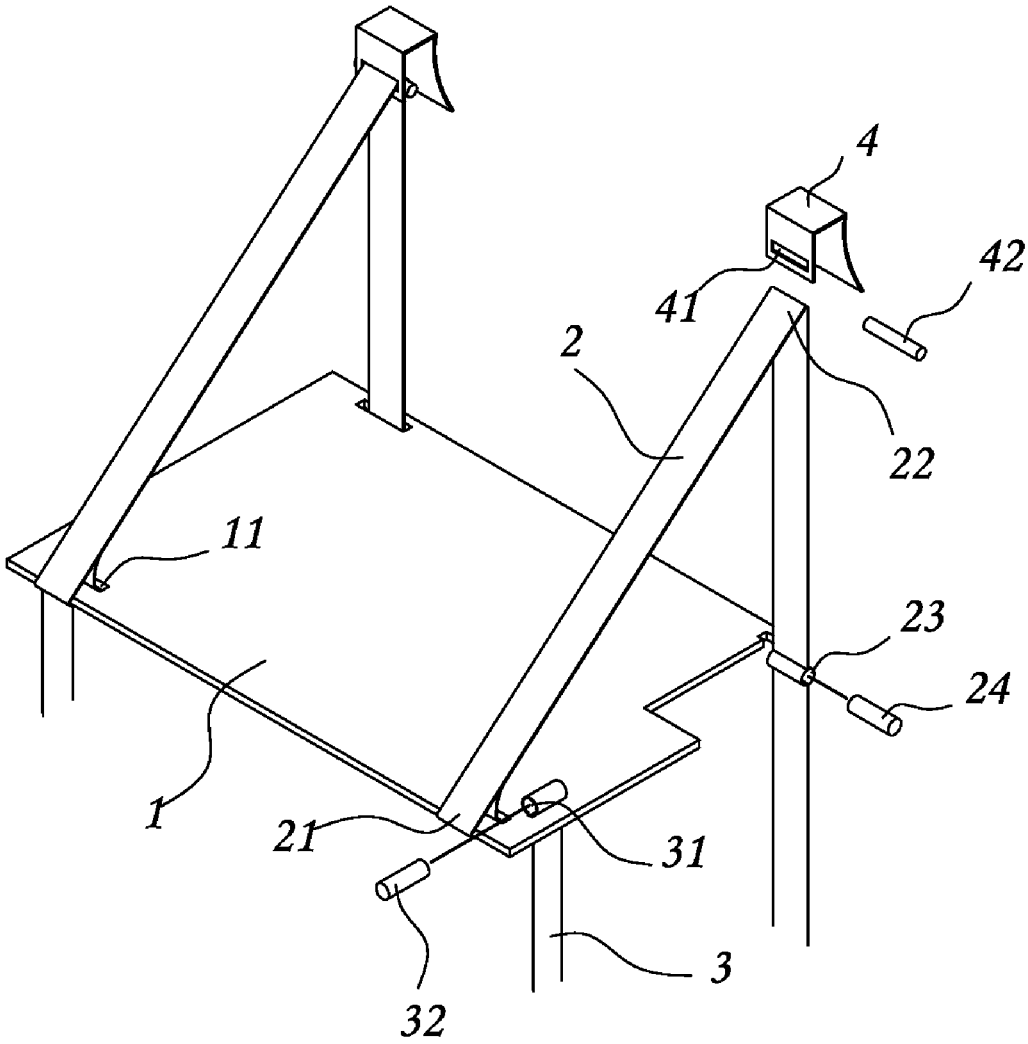
FIG. 3 is an exploded view of a part of FIG. 1, showing the mounting arrangement of the top panel, the hanging straps, the suspension straps and the hanging hooks.

Referring to FIG. 3, the mounting arrangement of the top panel 1, the hanging straps 2, the suspension straps 3 and the hanging hooks 4 is described hereinafter. The top panel 1 has a plurality of elongated slots 11 vertically cut through the top and bottom walls. Each hanging strap 2 has a transverse through hole 23 at a suitable location. The transverse through hole 23 can be formed by means of folding up a part of the hanging strap 2 and then fastening the folded part with stitches. One end 21 of each hanging strap 2 is inserted through one elongated slot 11 at the front side of the top panel 1 and then fixedly secured to the bottom wall of the top panel 1. The other end 22 of each hanging strap 2 is inserted through one elongated slot 11 at the rear side of the top panel 1 to have the transverse through hole 23 be disposed beneath the top panel 1, and then a pin 24 is inserted into the transverse through hole 23 and stopped at the bottom wall of the top panel 1. It is to be understood that the pin 24 has a diameter greater than the width of the elongated slot 11 so that the pin 24 stops the transverse through hole 23 at the bottom side of the top panel 1. A middle part of each hanging strap 2 above the top panel 1 is folded up and inserted through a transverse slot 41 of one hanging hook 4, and then a pin 42 is inserted into the space defined within the folded portion of the middle part of the respective hanging strap 2 to secure the respective hanging strap 2 to the respective hanging hook 4. Further, each suspension strap 3 is inserted through one respective elongated slot 11 of the top panel 1, having a transverse barrel 31 located on its one end and mounted with a pin 32 therein. The pin 32 stops the transverse barrel 31 at the top wall of the top panel 1.

Figure 4:
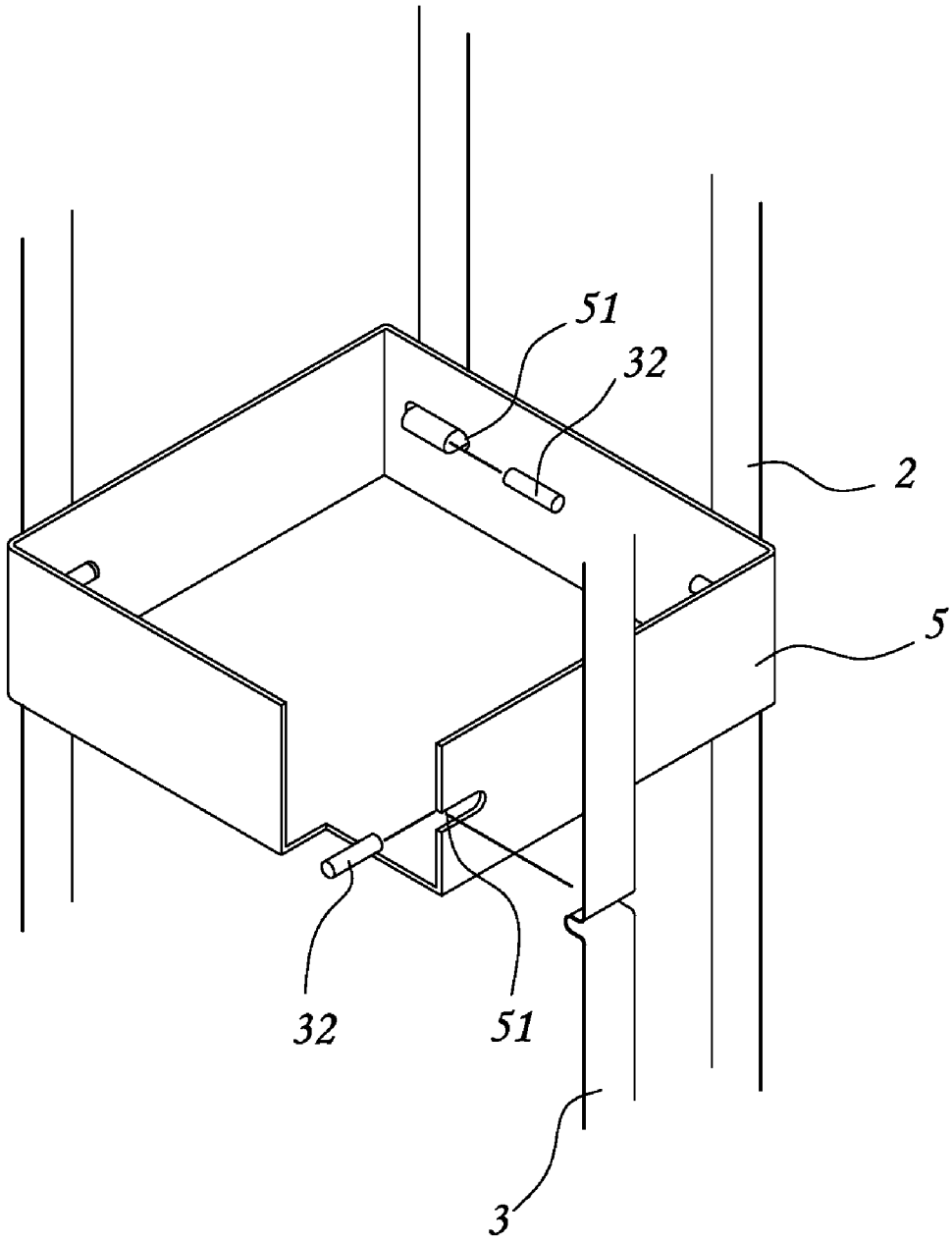
FIG. 4 is an exploded view of a part of FIG. 2, showing the mounting arrangement of the hanging straps, the suspension straps and one storage box.
Figure 4A:
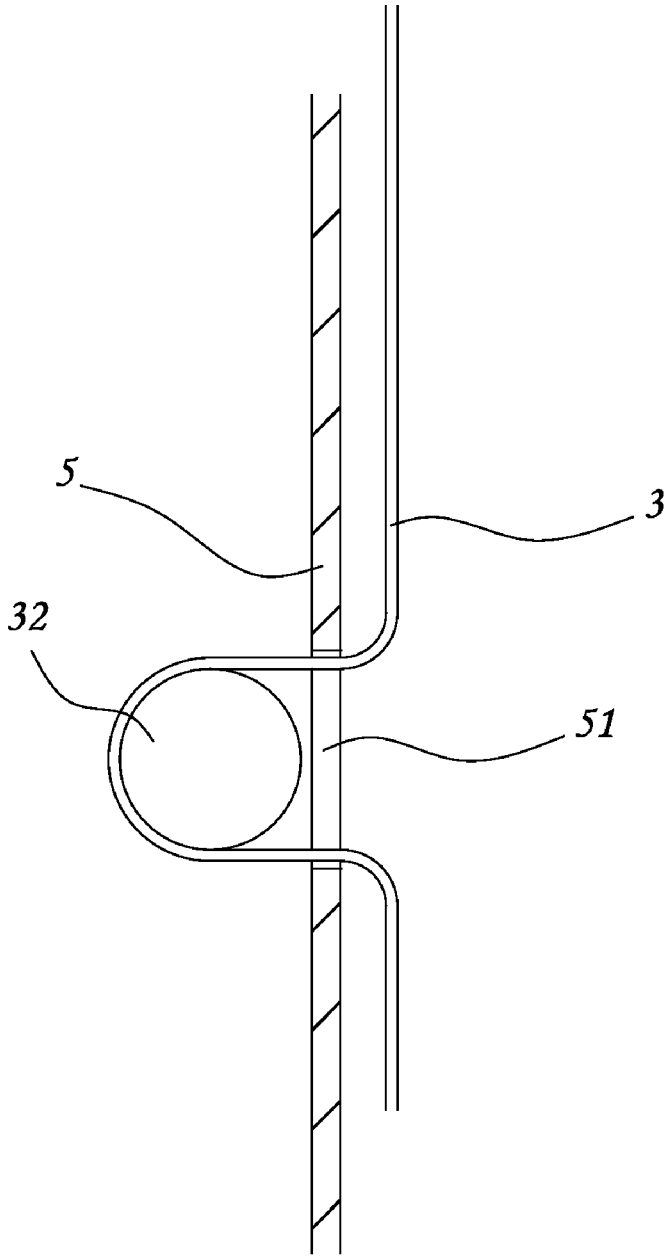
FIG. 4A is a sectional view in an enlarged scale of a part of FIG. 4.

Referring to FIGS. 4 and 4A, the mounting arrangement of the hanging straps 2, the suspension straps 3 and the storage boxes 5 is described hereinafter. Each storage box 5 has a plurality of horizontal slots 51 cut through each peripheral sidewall thereof. Each hanging strap 2 or suspension strap 3 has a part folded up and inserted through one horizontal slot 51 and then mounted with a pin 32 therein. The pin 32 stops the folded part of the associating hanging strap 2 or suspension strap 3 at one side of the associating peripheral sidewall of the associating storage box 5, thereby securing the respective hanging strap 2 or suspension strap 3 and the respective storage box 5 together.

Figure 5:
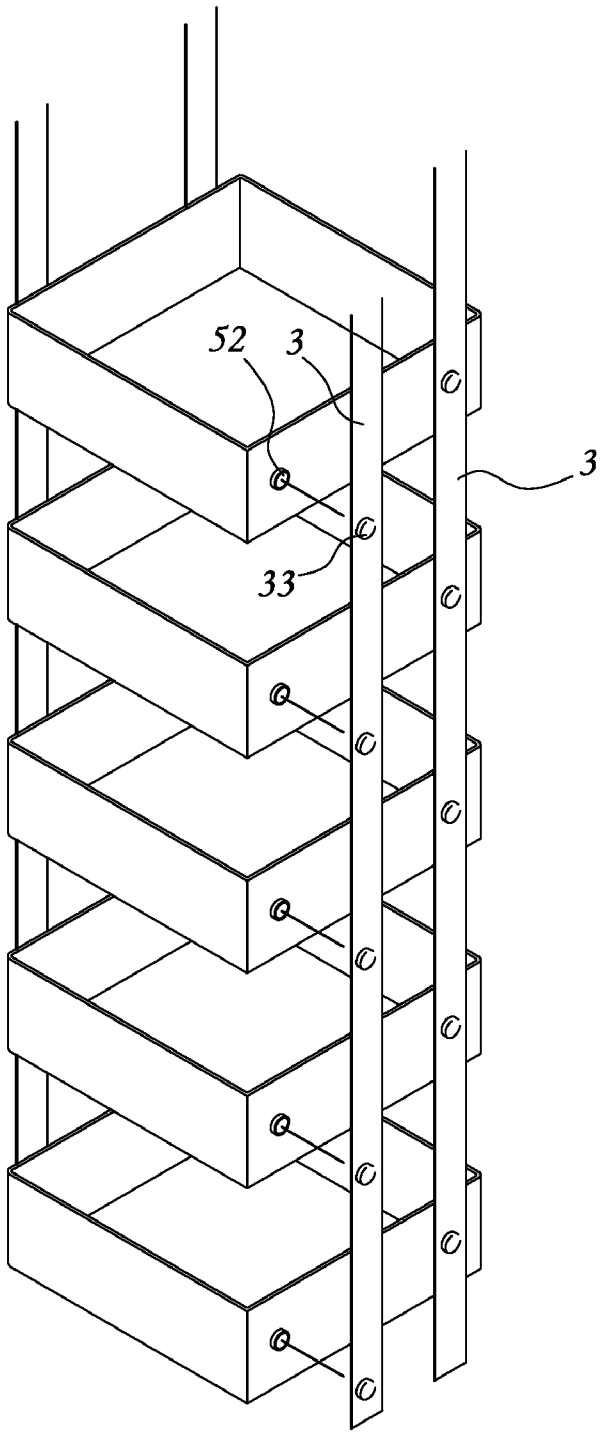
FIG. 5 is an exploded view of a part of the present invention, showing an alternate form of the connection structure between the storage boxes and the suspension straps.

Referring to FIG. 5, the connection between the storage boxes 5 and the suspension straps 3 can be done in another way. As illustrated, each storage box 5 has a plurality of first fastening members 52 fixedly located on the outside; each suspension strap 3 has a plurality of second fastening members 33 arranged at different elevations for fastening to the male (or female) fastening members 52 of the storage boxes 5. The first fastening members 52 can be male fastening members (stub, hook material, or the like) or female fastening members (socket, loop material, or the like). The second fastening members 33 can be female fastening members (socket, loop material, or the like) or male fastening members (stub, hook material, or the like) detachably connectable to the first fastening members 52.

Figure 6:
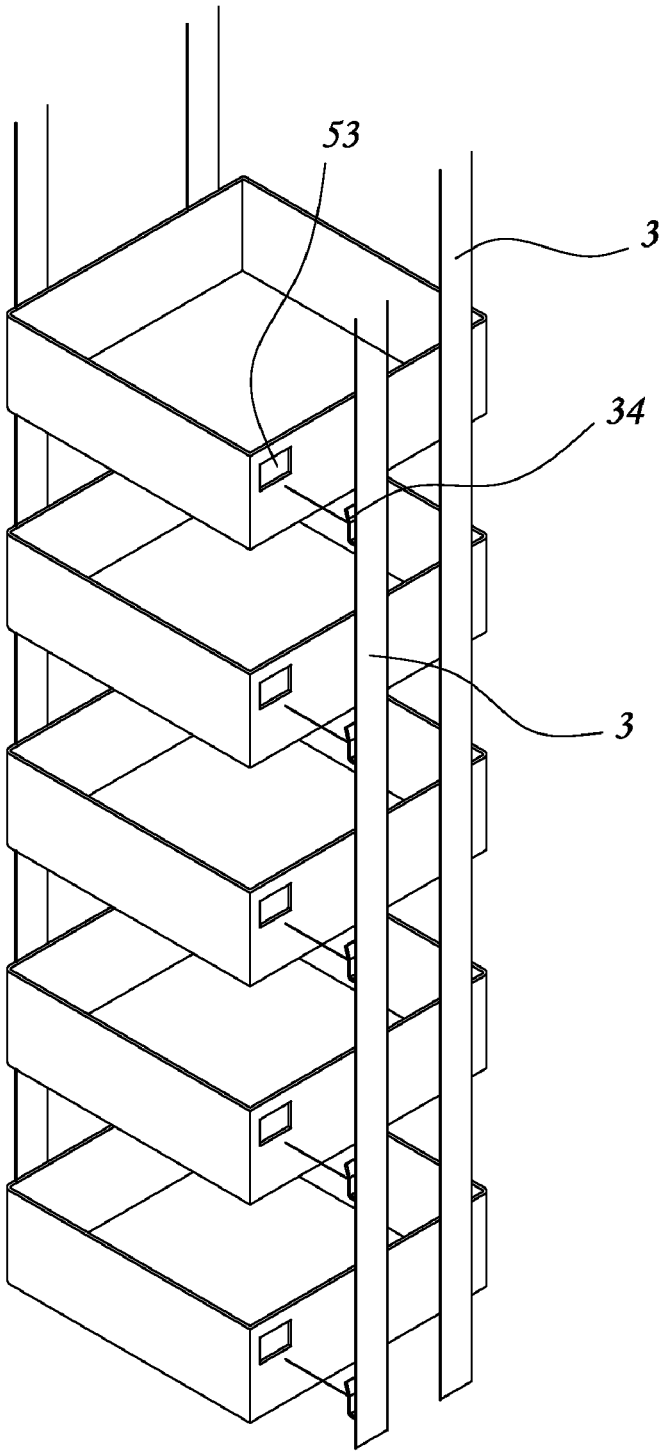
FIG. 6 is an exploded view of a part of the present invention, showing another alternate form of the connection structure between the storage boxes and the suspension straps.

Referring to FIG. 6, the connection between the storage boxes 5 and the suspension straps 3 can be done in still another way. As illustrated, each storage box 5 has a plurality of hook holes 53 fixedly located on the outside; each suspension strap 3 has a plurality of hooks 34 arranged at different elevations for hooking in the hook holes 53 of the storage boxes 5 to secure the storage boxes 5 in series at different elevations.

Figure 7:
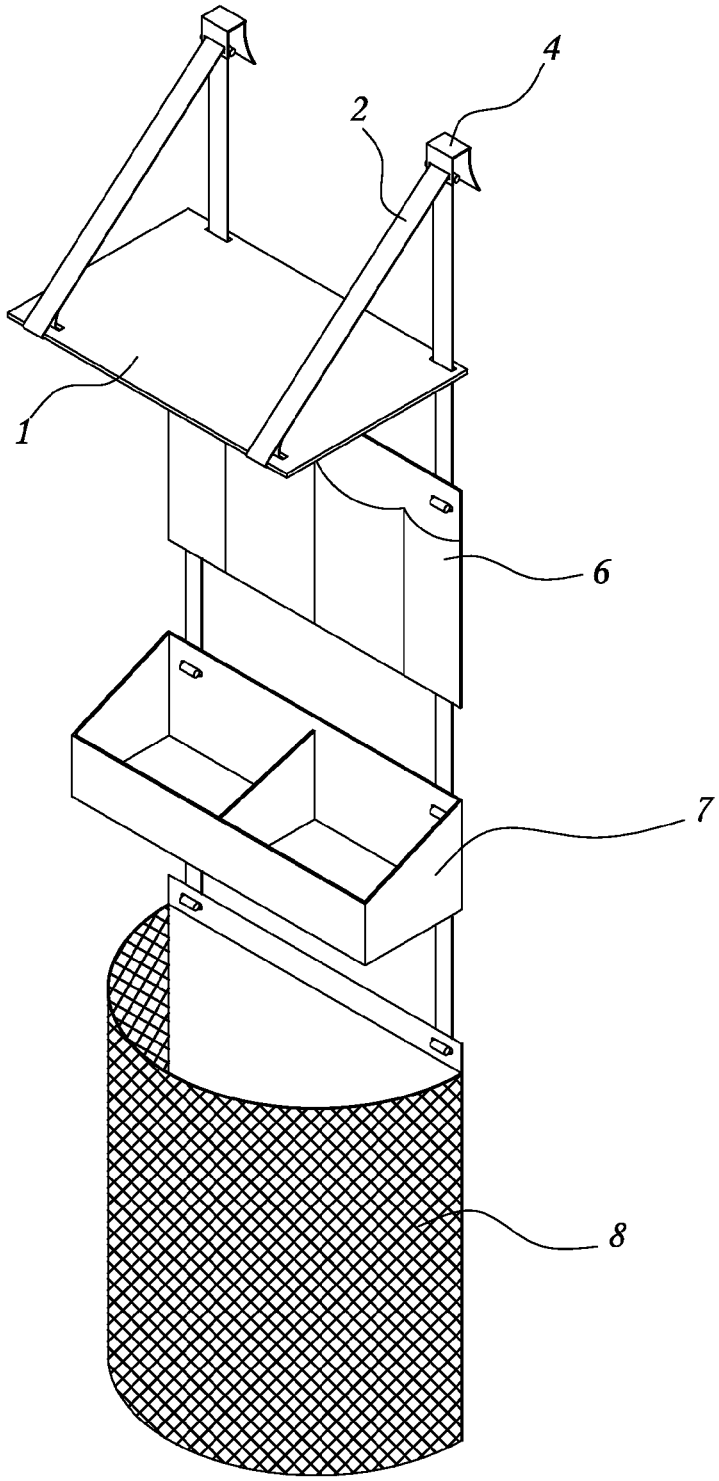
FIG. 7 is an elevational view, showing another alternate form of the hanging organizer in accordance with the present invention.

Referring to FIG. 7, the hanging organizer can be made simply by simply using the hanging straps 2 to hold different organizers 5 and 7 and a laundry basket 8 at different elevations below the top panel 1 and using the hanging hooks 4 to hang the hanging straps 2 on a door panel (not shown).

A prototype of hanging organizer has been constructed with the features of FIGS. 1~7. The hanging organizer functions smoothly to provide all of the features disclosed earlier.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hanging organizer, comprising:

a top panel (1), said top panel (1) comprising a plurality of vertical slots (11) cut through top and bottom walls thereof and respectively disposed near front and rear sides thereof;

a plurality of storage boxes (5), each said storage box (5) comprising a plurality of horizontal slots (51) cut through peripheral walls thereof;

a plurality of hanging straps (2), each said hanging strap (2) comprising a first end affixed to one vertical slot (11) near the front side of said top panel (1), a second end inserted through one vertical slot (11) near the rear side of said top panel (1), and a transverse through hole (23), each said hanging strap (2) having multiple portions thereof folded up and inserted through one horizontal slot (51) of each of said storage boxes (5);

a plurality of suspension straps (3) respectively inserted through one respective vertical slot (11) near the front side of said top panel (1), each said suspension strap (3) comprising a transverse through hole (31) located on one end thereof, each said suspension strap (3) having multiple portions thereof folded up and inserted through one horizontal slot (51) of each of said storage boxes (5);

a plurality of first pins (24) respectively inserted into the transverse through holes (23) of said hanging straps (2) and stopped at a bottom side of the bottom wall of said top panel (1); and a plurality of second pins (32) respectively inserted into the transverse through hole (31) of said suspension straps (3) and the folded portions of said hanging straps (2) and said suspension straps (3) and respectively stopped at a top side of the top wall of said top panel (1) and an inner side of each said storage box (5) to secure said storage boxes (5) to said hanging straps (2) and said suspension straps (3) at different elevations.

2. The hanging organizer as claimed in claim 1, further comprising a plurality of hanging hooks (4) fastened to said hanging straps (2) for hooking on the topmost edge of a door panel to hang said hanging straps (2) on said door panel, each said hanging hook (4) comprising a transverse slot (41), each said hanging strap (2) having a portion folded up and inserted through the transverse slot (41) of one said hanging hook (4) and mounted with a pin (42) in the folded portion to have the folded portion be secured to the associating hanging hook (4).

3. The hanging organizer as claimed in claim 1, wherein the first and second ends of said hanging straps (2) are respectively inserted through the vertical slots (11) of said top panel (1) and affixed thereto with stitches; said suspension straps (3) are respectively fastened to said top panel (1) and said storage boxes (5) at two opposite lateral sides.

4. The hanging organizer as claimed in claim 1, wherein each said storage box (5) comprises a plurality of hook holes (53) arranged at two opposite lateral sides thereof; said suspension straps (3) comprises a plurality of hooks (34) arranged at different elevations and respectively hooked in the hook holes (53) of said storage boxes (5).

5. The hanging organizer as claimed in claim 1, wherein each said storage box (5) comprises a plurality of first fastening members (52) located on two opposite lateral sides thereof; said suspension straps (3) comprises a plurality of second fastening members (33) arranged at different elevations and respectively detachably fastened to the first fastening members (52) of said storage boxes (5).

* * * * *